US007472454B2

(12) United States Patent
Hamm et al.

(10) Patent No.: US 7,472,454 B2
(45) Date of Patent: Jan. 6, 2009

(54) VACUUM CLEANER COMPRISING A CABLE COMPARTMENT

(75) Inventors: Silvio Hamm, Suelzfeld (DE); Roland Illig, Heustreu (DE); Thomas Strehler, Bad Neustadt (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 230 days.

(21) Appl. No.: 10/587,669

(22) PCT Filed: Jan. 26, 2005

(86) PCT No.: PCT/EP2005/050323

§ 371 (c)(1),
(2), (4) Date: Jul. 26, 2006

(87) PCT Pub. No.: WO2005/072590

PCT Pub. Date: Aug. 11, 2005

(65) Prior Publication Data

US 2007/0180647 A1 Aug. 9, 2007

(30) Foreign Application Priority Data

Jan. 30, 2004 (DE) ..... 10 2004 004 860

(51) Int. Cl.
*A47L 5/00* (2006.01)

(52) U.S. Cl. ..... 15/323; 15/327.2

(58) Field of Classification Search ..... 15/323, 15/327.2; *A47L 5/00, 9/00*
See application file for complete search history.

(56) References Cited

U.S. PATENT DOCUMENTS

| | | | |
|---|---|---|---|
| 2,958,894 | A | 11/1960 | Carabet |
| 3,002,216 | A | 10/1961 | Beach |
| 3,339,168 | A | 8/1967 | Belicka et al. |

FOREIGN PATENT DOCUMENTS

| | | |
|---|---|---|
| DE | 199 43 190 | 1/2001 |
| EP | 0 405 888 | 1/1991 |
| EP | 0 681 806 | 11/1995 |
| JP | 2002-28121 | 1/2002 |

OTHER PUBLICATIONS

International Search Report PCT/EP2005/050323.

*Primary Examiner*—David A Redding
(74) *Attorney, Agent, or Firm*—Russell W. Warnock; James E. Howard

(57) ABSTRACT

A vacuum cleaner comprising a housing containing a housing part for receiving components of electrical appliances, and a dust compartment which can be closed by a dust compartment cover that is mounted in such a way that it can pivot between a position wherein the dust compartment is closed and a position wherein the dust compartment is opened. Said cover is provided with a socket for the electrical supply of additional appliances, said socket being connected to an electrical line leading out of the housing part. The aim of the invention is to ensure the operating safety of the inventive vacuum cleaner over a very long period of time. To this end, the housing is provided with a compartment for automatically inserting a section of the electrical line during the pivoting of the dust compartment cover from the opening position to the closing position.

18 Claims, 3 Drawing Sheets

VACUUM CLEANER COMPRISING A CABLE COMPARTMENT

The invention relates to a vacuum cleaner.

A generic vacuum cleaner is known from EP1 082 937 A2. The vacuum cleaner there comprises a housing and a socket for an electric brush or the like, wherein the housing in a front dust collection space closed by a cover and, in a covered rear housing, space for receiving a suction fan is optionally provided with electronic speed control, a cable drum for the power supply of the fan motor and electrical connections for the socket. In the solution shown there, the socket for the electric brush is arranged in the dust compartment cover and the electrical leads to the socket are guided in a covered fashion in the cover hinge starting from the rear housing compartment. The hinge lever therein is combined with a cable connector so that the circuit to the socket is broken when opening the cover. A disadvantage however is that as a result of the frequent pivoting movements of the cover during use, the electrical detachable connection is exposed to significant wear.

On the other hand, if the electric cable is guided continuously in a covered fashion in the cover hinge without a cable connector, the cable becomes bent or kinked about a very narrow radius in the area of the pivot axis of the cover hinge on opening or closing the dust compartment cover. This in turn has the disadvantage that the electrical cable is exposed to high mechanical loads and there is the risk that the current-carrying wires of the electrical cable will break. As a consequence, malfunctions can occur during operation of the auxiliary equipment connected to the socket such as an electric brush, for example, and in unfavourable cases a fire can even occur in the vacuum cleaner as a result of the broken cable.

It is the object of the invention to eliminate the disadvantages of a generic vacuum cleaner, in particular to improve the vacuum cleaner so as to ensure operating safety over a fairly long time interval.

This object is achieved according to the invention by providing a compartment in the housing for automatically inserting a section of the electrical cable during pivoting of the dust compartment cover from an opening position to the position of the dust compartment cover which closes the compartment.

Since the section of the electrical cable running between the housing and the dust compartment cover is largely exposed and this free section of the electrical cable is inserted into the compartment according to the invention on closing the dust compartment cover, firstly jamming of this cable section between the dust compartment cover and the housing is reliably prevented and secondly, the free section of the electrical cable can be inserted largely free from stress in the compartment whilst forming the largest possible bending radii. Improved guidance of the electrical cable between the housing and the pivoting dust compartment cover is thereby achieved. In the inserted position of the cable section in the compartment, a plurality of bending regions having a large bending radius is formed instead of a single bending section having a very narrow radius. As a result of the compartment according to the invention, the exposed section of the electrical cable is also reliably guided so that it is eliminated that this free section of he electrical cable could possibly become jammed between the housing of the vacuum cleaner and the dust compartment cover on closing the dust compartment cover.

As a result of the compartment according to the invention, the free cable section is bent largely free from stress since the electrical cable is not forced to have a narrow bending radius at a fixedly predefined position but as a result of the formation of the compartment, the cable section is merely guided such that largely free bending is possible in the cable section, whereby the cable sections remains largely stress-free. As a result of the largely stress-free insertion of the cable section, the risk of breaks in the individual wires of the entire cable is minimised.

The compartment is preferably embodied as at least approximately rectangular and extends substantially perpendicular to the pivot axis of the dust compartment cover. As a result of the rectangular construction, a largely space-saving compartment is created wherein the cable section is laid bent preferably in a predefined plane. The alignment of the compartment substantially perpendicular to the pivot axis avoids lateral deflection of the cable section relative to the alignment of the pivot axis of the dust compartment cover. This measure particularly reliably avoids jamming of the cable section between the housing and dust compartment cover.

The compartment can preferably have a width between once and twice the width of the electrical cable. In order to be able to lay the cable in the compartment at all, the compartment must be at least as wide as the diameter of the electrical cable. In this case, it can be advantageous if the compartment is precisely matched to the diameter of the electrical cable, that is the side walls of the compartment abut directly against the electrical cable without jamming this. In order to keep the friction between the moving electrical cable and the fixed side walls of the compartment as low as possible, the width of the compartment can be selected to be slightly larger than the diameter of the electrical cable. Thus, no linear contact but merely point contact at a plurality of points prevails between the electrical cable and the walls of the compartment. Such point contact at a plurality of locations results in considerably less friction than in the case of linear contact. If the compartment is embodied as twice the width, that is the width of the compartment is twice the diameter of the electrical cable, the free cable section can lie in two planes in the compartment. This can be especially advantageous if the compartment can only have small dimensions because of the spatial conditions at the vacuum cleaner. If the width is double, the compartment can be shortened to half its longitudinal extension.

The compartment can be arranged in an appliance cap which covers the housing part. For electrical connection of the socket the electrical cable is usually brought into contact with electrical appliance components already provided in the vacuum cleaner. The electrical cable is preferably brought into contact with switching components, printed circuit board or a cable drum. If the compartment is integrated directly in the appliance cap which covers the housing part containing the electrical appliance components such as the switches, the printed circuit board or the cable drum, only a short electrical cable is required for contact with the socket. This contributes to the cost-effective manufacture of the vacuum cleaner. The compartment can be manufactured cost-effectively together with the appliance cap as a one-piece plastic part by injection moulding.

It is likewise cost-effective and therefore advantageous if the appliance cap has a hinge joint at which the dust compartment cover is hinged. For example, bearing eyes can be moulded on the appliance cap wherein hinge pins moulded on the dust compartment cover engage. The bearing eyes on the appliance cap together with the bearing pins of the dust compartment cover form the hinge connection. Alternatively, in one design variation the bearing eyes can naturally also be formed on the dust compartment cover and the bearing pins on the appliance cap.

The compartment is preferably disposed above a cable drum provided in the housing part. As a result of this arrangement of the compartment very close to the cable drum, a very short path is obtained between the compartment and the cable drum so that the electrical cable can be embodied as very short. This is particularly the case if the socket is directly connected to the cable drum by means of the electrical cable.

In a preferred embodiment of the invention, the compartment has an opening which can be closed by a cover. The compartment preferably has an upper opening. This opening is preferably closed by a separate cover. As a result of such an opening in the compartment, the free section of the electrical cable can be simply inserted in the compartment during assembly. The cover can be formed as a separate component and can have locating lugs for securing it, for example, which engage in corresponding locating grooves on the compartment. Other especially detachable and also non-detachable connecting means can also be used. Alternatively, the cover can be moulded on the compartment for example in one piece by means of a film hinge. This has the advantage that the compartment and cover only form a single component, the cover cannot be lost and nevertheless, the electrical cable can be mounted simply.

In an advantageous variant in the one-piece and in the two-piece construction of compartment and cover, the cover can have a web which together with at least one opposing counter-web on the compartment forms a tension-relieving means for the electrical cable. For example, if the cover closes an upper opening of the compartment, the compartment preferably has two counter-webs on its bottom inner wall which extend upwards in the direction of the web of the cover, respectively one counter-web being guided past on one or other side of the web of the cover. The web or the webs and counter-webs intermesh in a finger-like manner, forming a labyrinth-like intermediate space having a somewhat smaller width than the diameter of the electric cable. If the cover is attached to the compartment, the electrical cable is clamped between the compartment and cover by the web and counter-webs in such a manner that the electrical cable is fixed and when pulling on the free section of the electrical cable, this cannot be pulled out beyond a predetermined amount. This prevents tensile forces being exerted on the electrical contact of the cable inside the vacuum cleaner when pulling on the electrical cable. Any damage to this electrical contact is prevented by means of stress relief.

The cover according to the invention preferably has a recess at one edge section. The recess is used for guiding the free section of the electrical cable out from the compartment. The recess can be embodied as a hole in the cover but should preferably be embodied as an open-edged recess on an edge section of the cover so that it is no longer necessary to thread the electrical cable through any closed recess during assembly. The open-edged recess can either be provided exclusively on the cover or in addition to the open-edged recess on the cover, another open-edged recess can preferably be provided on the compartment so that the recess is formed by an expanded edge gap between the cover and the compartment. Such a recess is especially advantageous for assembly since complex threading-in of the electrical cable is eliminated. In this case, during assembly the free section of the electrical cable is first laid in the compartment such that the electrical cable abuts against the recess on the compartment. The cover with its open-edged recess is then placed on the electrical cable inserted in the compartment and the cover is snapped-in or clipped-on the opening of the compartment.

At least one of the recesses can have a starting slope for the electrical cable. A starting slope is to be understood as any formation adapted to the contour of the electrical cable which smoothes an otherwise sharp edge of the open-edged recess on the cover or on the compartment, that is, forms a flat support for the electrical cable. This has the advantage that when pulling out or pushing in the free section of the electrical cable, the surface of the electrical cable slides along on a defined surface and any scraping or scratching of the electrical cable on a possible sharp-edged edge section is prevented. A starting slope according to the invention helps to extend the life of the electrical cable and ensures a high number of pivoting movements of the dust compartment cover without functional disturbances occurring. It can be sufficient to provide the starting slope either exclusively on the cover, exclusively on the compartment or both on the cover and on the compartment. The starting slope can be arranged so that it runs at an angle to the perpendicular run-in direction. An actual inclination of the starting slope can be adapted as a result of the technical circumstances, that is the type of electrical cable and the size or arrangement of the dust compartment cover and compartment. The adaptation should be made such that a preferred direction is predefined for the free section of the electrical cable running into the compartment which allows bending or laying of the electrical cable in the compartment with the lowest stress possible.

A separate rib is preferably provided for stress-free run-in of the free section of the electrical cable. Such a rib is provided to deflect the electrical cable away from a wall of the compartment. The rib points in particular into the compartment. The rib is preferably provided on the inner side of a wall of the compartment, preferably on the bottom of the compartment. In a cost-effective configuration the rib is moulded directly on the compartment. In particular, the rib is arranged in a central area at the bottom of the compartment and extends substantially perpendicularly upwards, preferably to a maximum of half the height of the compartment. When closing the dust compartment cover, the electrical cable has a tendency to lay directly against the inner walls of the compartment and only bending after the cable sections has laid completely against the inner walls of the compartment. In this case, high friction forces need to be overcome which could possibly result in difficult closure of the dust compartment cover. A rib according to the invention is provided to remedy this. The previously described rib according to the invention deflects the electrical cable away from the inner wall of the compartment early on during insertion into the dust compartment so that only a small portion of the surface of the electrical cable comes to rest on the inner walls of the compartment. This not only reduces friction between the electrical cable and compartment but a preferred bending direction is predefined for the free section of the electrical cable. Depending on the size of the compartment and the type of electrical cable, either a single rib or a plurality of ribs can be provided. These should be suitably dimensioned in position, alignment and height so that stress-free run-in of the electrical cable into the compartment is achieved. Depending on whether the electrical cable is embodied as twin-core, three-core or having an enlarged conductor cross-section, the electrical cable can have a higher or lower stiffness. For example, a twin-core flat cable has a significantly lower stiffness than a three-core round cable. The shape and size of the compartment also plays a decisive role. The ribs according to the invention for deflecting the electrical cable away from a wall of the compartment should thus be configured or tuned individually for each individual case.

A preferred exemplary embodiment of a vacuum cleaner according to the invention is explained in detail hereinafter with reference to FIGS. 1 to 3.

Figure 1:
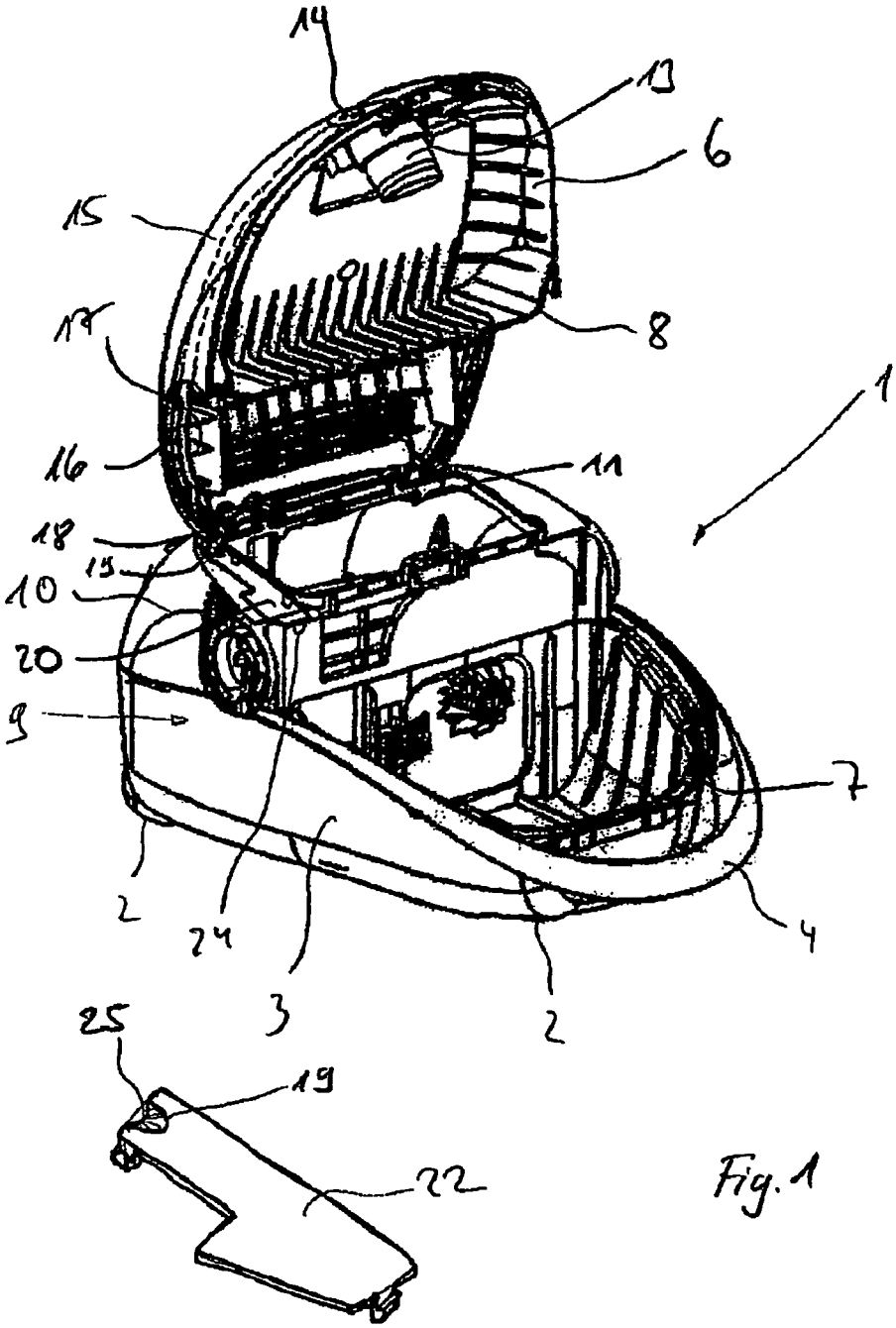
FIG. 1 is a perspective view of a vacuum cleaner according to the invention with a compartment integrated in an appliance cap.
Figure 3:
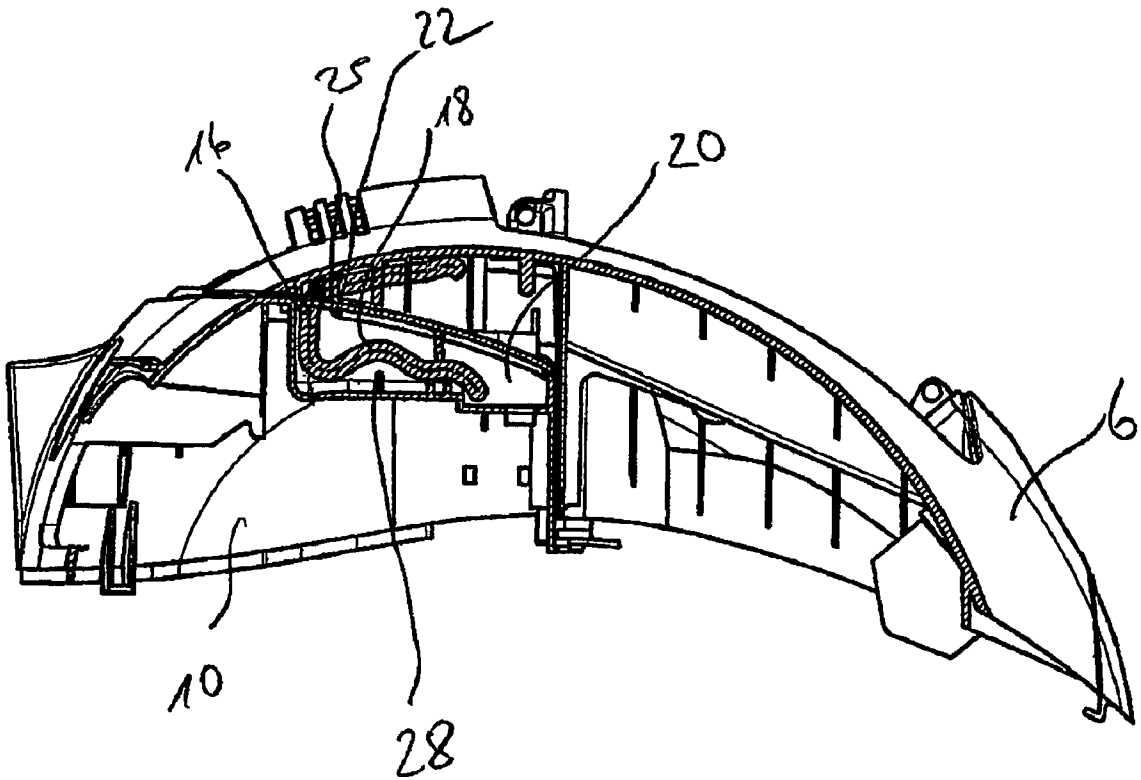
FIG. 3 is a partial section through the appliance cap from FIG. 2 with a closed dust compartment cover and a section through the compartment from FIG. 2.

FIG. 1 shows an exemplary embodiment of a vacuum cleaner according to the invention. The vacuum cleaner has a multi-part housing 1. A lower shell 3 of the housing 1 provided with castors 2 has a carrying handle 4 at its front end. A dust compartment 5 is provided inside the front part of the lower shell 3 provided with the carrying handle 4. Either a conventional dust bag not shown or a fixed separator box can be inserted in the dust compartment 5. The dust compartment 5 can be closed by means of a dust compartment cover 6. In the closed position of the dust compartment cover 6 a sealing cord 7 provided on the lower shell 3 abuts against a sealing edge 8 of the dust compartment cover 6. In a rear area of the lower shell 3 the dust compartment 5 is adjoined by a housing part 9 which contains functional components of the vacuum cleaner not shown and is closed by means of an appliance cap 10. Hinge lugs 11 are moulded on an upper side of the appliance cap 10 and hinge pins 12 of the dust compartment cover 6 engage therein. By means of the hinge lugs 11 and hinge pins 12, the dust compartment cover 6 is mounted on the appliance cap 10 so that it can pivot from the open position shown in FIG. 1 into a position which closes the dust compartment. The dust compartment cover 6 bears a connecting piece 13 for a suction hose not shown. Provided in the immediate vicinity of the connecting piece 13 is a socket 14 for the electrical supply of additional appliances, especially an electrically driven suction nozzle. The socket 14 is preferably moulded directly on the dust compartment cover 6. An electrical cable 16 runs along a wall section 15 of the dust compartment cover 6 starting from the socket 14 and extending close to the hinge connection of hinge lugs 11 and hinge pins 12. The electrical cable 16 is held in the dust compartment cover 6 by means of a plurality of clamping ribs 17. The electrical cable 16 has a free section 18 in the hinge area between the dust compartment cover 6 and the appliance cap 10, which allows the dust compartment cover 6 to pivot from the open position shown in FIG. 1 into a position which closes the dust compartment 5 (FIG. 3). The free section 18 of the electrical cable 16 dips into the interior of the housing part 9 at an upper side of the appliance cap 10 by means of a recess 19. Located in front of the recess 19 is a compartment 20 integrated in the appliance cap 10. The compartment 20 has an upper opening 21 which is closed by means of a cover 22, leaving the recess 19 open. The cover 22 has locating lugs 23 provided in corresponding locating grooves 24 on the compartment or on the appliance cap 10. On the cover 22 the recess 19 is embodied as an open-edged recess and bears a starting slope 25 at its edge. Another starting slope 26 corresponding to the starting slope 25 is provided on the appliance cap 10 at an edge of the recess 19.

Figure 2:
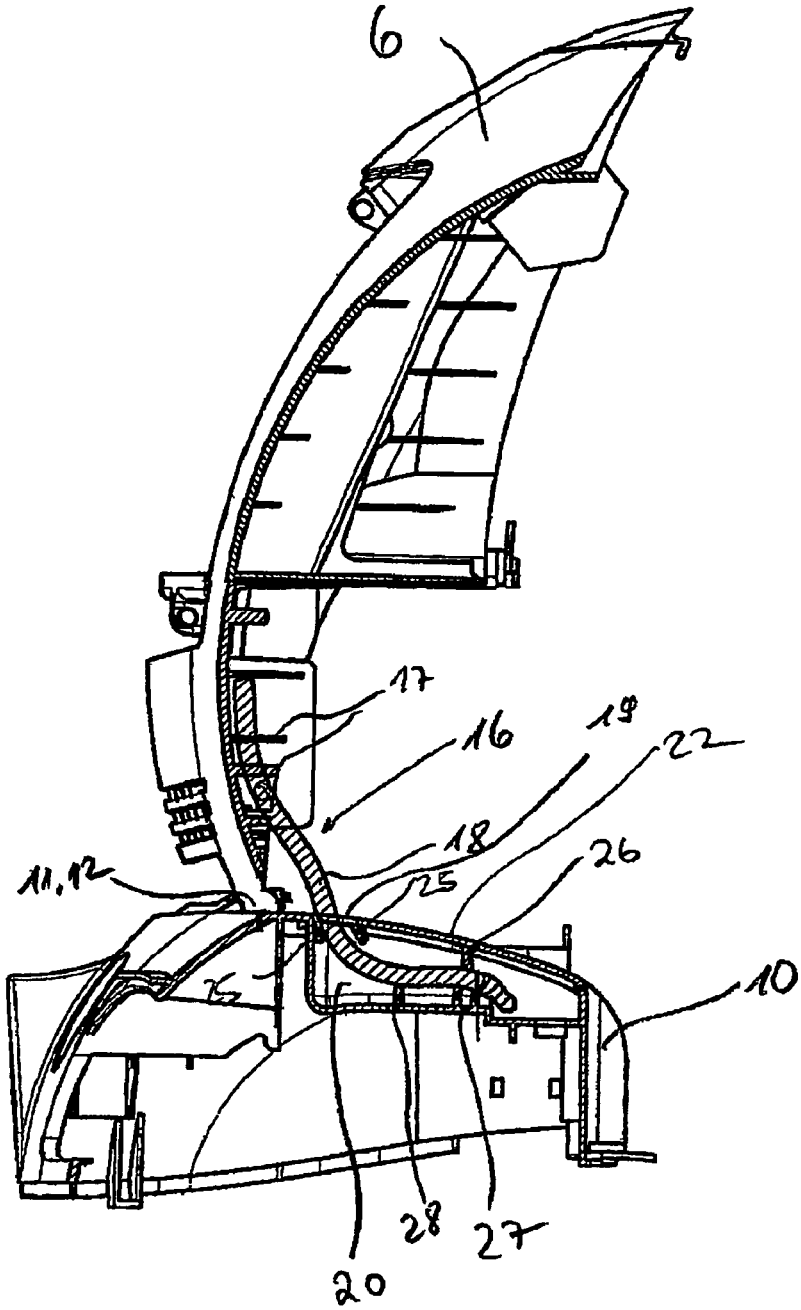
FIG. 2 is a partial section through the appliance cap and an opened dust compartment cover of the vacuum cleaner from FIG. 1 with a section through a compartment according to the invention.

In FIG. 2 the appliance cap 10 is shown in a sectional view. The section runs through the compartment 20 which is moulded directly on the appliance cap 10. The dust compartment cover 6 is pivotally mounted on the appliance cap 10 by means of the hinge connection 11 and 12. The free section 18 of the electrical cable 16 is fixed on the one hand by means of the clamping ribs 17 on the dust compartment cover 6 and on the other hand, by means of a web 26 which is moulded on the cover 22. The web 26 projects into the compartment 20 in the direction of the electrical cable 16 starting from an inner wall of the cover 22. Two counter-webs 27 are moulded on the bottom of the compartment 20 opposite to the web 26. The free section 18 of the electrical cable 16 is clamped between the web 26 and the counter-webs 27 in a labyrinth fashion and is thereby fixed in the compartment 20 or the appliance cap 10. Respectively one starting slope 25 is moulded on the edge of the recess 19. A rib which projects into the compartment 20 is moulded on the bottom of the compartment 20. When inserting the electrical cable 16 during closure of the dust compartment cover 6, the free section 18 of the electrical cable 16 slides along the starting slope 25 into the interior of the compartment 20. The free section 18 thereby comes to lie on the upper edge of the rib 28 so that the free section 18 is curved upwards above the rib 28. As a result of the upward curvature of the free section 18, the electrical cable 16 is inserted in the interior of the compartment 20 in a space-saving manner. The stowed position of the electrical cable 16 is shown in FIG. 3.

FIG. 3 shows a cross-section through the appliance cap 10 and the dust compartment cover 6. The dust compartment cover 6 is located in a position whereby the dust compartment 5 is closed. FIG. 3 also shows in cross-section the compartment 20 with the free section 18 of the electrical cable 16 completely inserted therein. The free section 18 of the electrical cable 16 is curved above the rib 28 into the centre of the compartment 20. In the closed position of the dust compartment cover 6 the electrical cable 16 abuts against a starting slope 25 of the open-edged recess 19 at an edge of the cover 22. The free section 18 of the electrical cable 16 is no longer in contact with the rib 28 as a result of its curvature in the closed position of the dust compartment cover 6.

The invention claimed is:

1. A vacuum cleaner comprising a housing containing a housing part for receiving components of electrical appliances and a dust compartment which can be closed by a dust compartment cover that is pivotally mounted to the housing for movement between a closed position wherein the dust compartment is closed and an open position wherein the dust compartment is opened, said cover being provided with a socket for the electrical supply of additional appliances, said socket being connected to an electrical cable leading out of the housing part, wherein the housing is provided with a cable compartment for automatically inserting a section of the electrical cable during pivoting of the dust compartment cover from the open position to the closed position which closes the dust compartment.

2. The vacuum cleaner according to claim 1, wherein the cable compartment has a substantially rectangular shape and extends substantially perpendicular with respect to a pivot axis of the dust compartment cover.

3. The vacuum cleaner according to claim 2, wherein the cable compartment has a width between once and twice the width of the electrical cable.

4. The vacuum cleaner according to claim 1, wherein the cable compartment is arranged in an appliance cap which at least partially covers the housing part.

5. The vacuum cleaner according to claim 4, wherein the appliance cap has a hinge joint on which the dust compartment cover is hinged.

6. The vacuum cleaner according to claim 4, wherein the cable compartment is disposed above a cable drum disposed in the housing part.

7. The vacuum cleaner according to claim 1, wherein the cable compartment includes an opening and a cable compartment cover for closing the opening.

8. The vacuum cleaner according to claim 7, wherein the cable compartment cover has locating means for securing the cable compartment cover on the cable compartment.

9. The vacuum cleaner according to claim 7, wherein the cable compartment cover has a web which together with at least one opposing counter-web on the cable compartment forms a tension-relieving means for the electrical cable.

10. The vacuum cleaner according to claim 7, wherein the cable compartment cover has a recess at one edge section which, in addition to an additional recess on the cable compartment, forms an inlet opening for the electrical cable.

11. The vacuum cleaner according to claim 10, wherein at least one of the recess and the additional recess has a starting slope for the electrical cable.

12. The vacuum cleaner according to claim 1, further comprising a rib being provided on the cable compartment and projecting into the cable compartment to deflect the electrical cable away from a wall of the cable compartment.

13. The vacuum cleaner according to claim 12, wherein the rib is molded on an inner side of the wall of the cable compartment.

14. The vacuum cleaner according to claim 12, wherein the rib is disposed in a central area at the bottom of the cable compartment and extends substantially vertically upwardly.

15. A vacuum cleaner comprising:

a housing containing a cable compartment and containing a housing part for receiving components of electrical appliances;

a dust compartment;

a dust compartment cover that is movably mounted to the housing for movement between a closed position wherein the dust compartment is closed by the dust compartment cover and an open position wherein the dust compartment is opened;

a socket mounted to the dust compartment cover, the socket for the electrical supply of additional appliances;

an electrical cable, the electrical cable having one end connected to the socket that is mounted to the dust compartment cover, an opposite end connectable to an electrical lead, and a free section at a location between the one end and the opposite end;

means for engaging the electrical cable at an upstream location thereon between the free section and the one end to hold the upstream location of the electrical cable at a fixed position relative to the dust compartment cover; and means for engaging the electrical cable at a downstream location thereon between the free section and the opposite end to hold the downstream location of the electrical cable at a fixed position relative to the cable compartment, the free section extending between the cable compartment and the dust compartment cover and movement of the dust compartment cover from its open position to its closed position effecting an insertion of the free section of the electrical cable into the cable compartment and movement of the dust compartment cover from its closed position to its open position effecting a withdrawal of the inserted free section of the electrical cable from the cable compartment.

16. The vacuum cleaner according to claim 15, wherein the upstream location of the electrical cable at a fixed position relative to the dust compartment cover and the downstream location of the electrical cable at a fixed position relative to the cable compartment are at a predetermined spacing from one another in the open position of the dust compartment cover and the upstream location of the electrical cable and the downstream location of the electrical cable are at another spacing less than the predetermined spacing in the closed position of the dust compartment cover.

17. The vacuum cleaner according to claim 16 and further comprising a rib provided on the cable compartment and projecting into the cable compartment to deflect the electrical cable away from a wall of the cable compartment.

18. The vacuum cleaner according to claim 16, wherein the rib is molded on an inner side of the wall of the cable compartment.

* * * * *